US008790473B2

(12) United States Patent
Bhowal et al.

(10) Patent No.: US 8,790,473 B2
(45) Date of Patent: Jul. 29, 2014

(54) METHOD FOR FORGING METAL ALLOY COMPONENTS FOR IMPROVED AND UNIFORM GRAIN REFINEMENT AND STRENGTH

(75) Inventors: Prabir R. Bhowal, Rocky Hill, CT (US); Agnieszka M. Wusatowska-Sarnek, Mansfield Ctr., CT (US)

(73) Assignee: United Technologies Corporation, Hartford, CT (US)

( * ) Notice: Subject to any disclaimer, the term of this patent is extended or adjusted under 35 U.S.C. 154(b) by 0 days.

(21) Appl. No.: 13/206,904

(22) Filed: Aug. 10, 2011

(65) Prior Publication Data

US 2013/0037184 A1 Feb. 14, 2013

(51) Int. Cl.
*C22F 1/10* (2006.01)
*C22C 19/05* (2006.01)

(52) U.S. Cl.
USPC ..... 148/676; 148/428

(58) Field of Classification Search
USPC ..... 148/426, 676, 428; 420/448, 451, 453, 420/459, 460
See application file for complete search history.

(56) References Cited

U.S. PATENT DOCUMENTS 4,608,094 A 8/1986 Miller et al.
5,120,373 A 6/1992 Miller et al.
5,360,496 A 11/1994 Kuhlman et al.
5,374,323 A 12/1994 Kuhlman et al.
5,649,280 A 7/1997 Blankenship et al.
5,759,305 A 6/1998 Benz et al.
6,059,904 A 5/2000 Benz et al.
6,409,853 B1 6/2002 Thamboo et al.
6,565,683 B1 5/2003 Utyashev et al.

OTHER PUBLICATIONS

Bhowal, P.R. & Schirra, J.J. (2001). Full scale gatorizing of fine grain incone. TMS, 2001.
Cao, W. (2006). Recommendations for Heat Treating Allvac 718Plus Alloy Parts. ATI Alvac.
Dix, A.W., Hyzak, J. M., & Singh, R.P. (1992). Application of Ultra Fine Grain Alloy 718. TMS, 1992.
Zhang, H.Y., Zhang, S.H., Cheng, & Li, Z.X. (2010). Deformation characteristics of δ phase in the delta-processed Incolnel 718 alloy. Materials Characterization. 1(1), 49-53.
European Search Report completed Dec. 11, 2012 for European Patent Application No. 112179557.9.

*Primary Examiner* — Roy King
*Assistant Examiner* — Caitlin Kiechle
(74) *Attorney, Agent, or Firm* — Carlson, Gaskey & Olds, P.C.

(57) ABSTRACT

A method of forging includes a first forging action that changes the shape of a metallic alloy work piece. A second forging action further changes the shape of the metallic alloy work piece after the first forging action. A heat treatment step is conducted after the first forging action and prior to the second forging action. The heat treatment step includes subjecting the metallic alloy work piece to a heat treatment temperature that alters the microstructure of the metallic alloy work piece without the application of a forging action that changes the shape of the metallic alloy work piece.

1 Claim, 1 Drawing Sheet

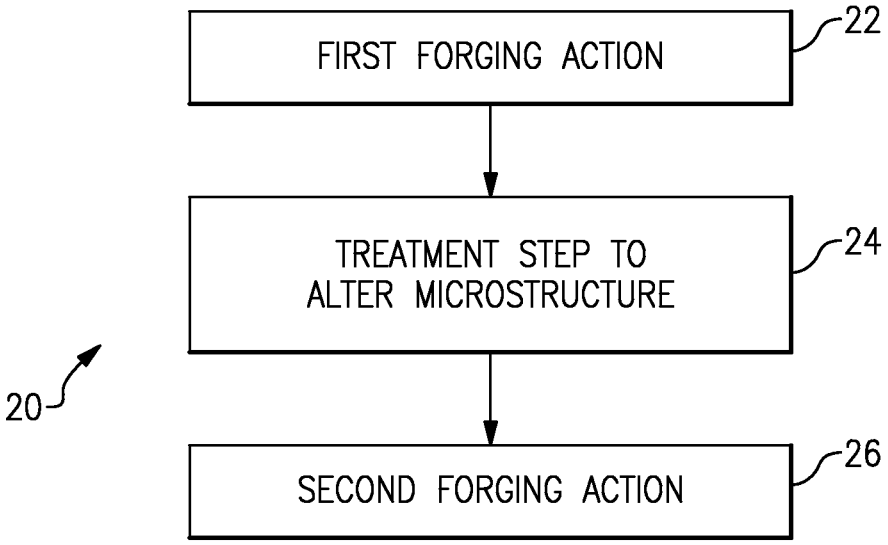
FIRST FORGING ACTION
22
TREATMENT STEP TO
ALTER MICROSTRUCTURE
24
20
SECOND FORGING ACTION
26

METHOD FOR FORGING METAL ALLOY COMPONENTS FOR IMPROVED AND UNIFORM GRAIN REFINEMENT AND STRENGTH

BACKGROUND

This disclosure relates to the forging of metallic alloy components.

Metallic alloy components, such as components for gas turbine engines, are typically fabricated in a multi-step forging process. The forging temperature and percent reduction in forging height of the component are tightly controlled at each step of the forging process. The properties of the final component depend upon the parameters that are selected for the forging steps. For instance, the percent reduction in forging height and the forging temperatures are controlled to meet required properties in the final component, without the need for post-forming processes such as solution heat treatment and aging. For gas turbine engine components or other components that must meet required properties, there is limited ability to change the forging process and still meet the requirements.

SUMMARY

Disclosed is a method of forging that includes a first forging action that changes the shape of a metallic alloy work piece. A second forging action further changes the shape of the metallic alloy work piece after the first forging action. A heat treatment step is conducted after the first forging action and prior to the second forging action. The heat treatment step includes subjecting the metallic alloy work piece to a heat treatment temperature that alters the microstructure of the metallic alloy work piece without the application of a forging action that changes the shape of the metallic alloy work piece.

In another aspect, a method of forging includes a treatment step that is conducted after the first forging action and prior to the second forging action. The treatment step includes altering the microstructural average grain size of the metallic alloy work piece without the application of a forging action that changes the shape of the metallic alloy work piece.

The various features and advantages of the disclosed examples will become apparent to those skilled in the art from the following detailed description. The drawings that accompany the detailed description can be briefly described as follows.

BRIEF DESCRIPTION OF THE DRAWING

FIG. 1 illustrates an example method of forging.

DETAILED DESCRIPTION

FIG. 1 illustrates an exemplary method 20 of forging a metallic alloy work piece. For example, the method 20 can be used in a forging process to produce a gas turbine engine component, such as a turbine disk. In some examples, the component is a disk for a high pressure compressor, a high pressure turbine disk or a low pressure turbine disk. It is to be understood, however, that this disclosure is not limited to gas turbine engine components and that other metallic alloy components will benefit.

In the illustrated example, the method 20 is used with a work piece that includes or is a nickel-based alloy. In a further example, the nickel-based alloy has a composition that includes 50-55 wt. % nickel, 17-21 wt. % chromium, 2.8-3.3 wt. % molybdenum, 4.75-5.5 wt. % niobium, 0.65-1.15 wt. % titanium, 0.2-0.8 wt. % aluminum and a balance of iron and trace elements. In a further example, the nickel-based alloy is INCONEL 718. In other examples, other kinds of alloys are used, such as cobalt-based alloys.

For turbine engine disks or other components that must meet predetermined property requirements, the fabrication process plays an important role. The fabrication process controls the microstructure of the alloy, which controls the properties of the component. For instance, in forging, the forging temperatures and percent reduction in forging height of the work piece control the microstructure that dictates the end properties of the component. As will be described, the example method 20 uses a treatment step in the forging process to refine the microstructure and meet property requirements in the end component.

In the illustrated example, the method 20 includes a first forging action 22, a treatment step 24 that follows the first forging action 22, and a second forging action 26. The treatment step 24 between the first forging action 22 and the second forging action 26 alters the microstructure of the metallic alloy work piece to achieve a more homogenous microstructure in the end component.

In the first forging action 22, the shape of the metallic alloy work piece is changed. For instance, in the example of a nickel-based alloy, the first forging action includes up-setting a billet of the alloy, or a preform of the alloy (a previously forged billet to a preform state) at a temperature equal to or greater than 1800° F. (982° C.). The temperature and work applied to the metallic alloy work piece in the first forging action 22 results in a percent reduction in forging height. For example, to meet required properties for a gas turbine engine disk component, the percent reduction in forging height is in the range 40% to 80%. In one example, the combination of the exemplary temperature and percent reduction for the nickel-based alloy results in a microstructural average grain size in a range of ASTM 6 to ASTM 10 that are often non-uniformly distributed. The grain size can be determined through known metallurgical methods and standards according to ASTM E-112.

After the first forging action 22, the metallic alloy work piece is transferred to a furnace for the treatment step 24. The treatment step 24 is separately conducted from the first forging action 22 and is conducted without the application of a forging action that changes the shape of the metallic alloy work piece. Thus, the treatment step 24 is conducted within the forging process but is not a forging step that alters the shape. In the treatment step 24, the metallic alloy work piece is subjected to a heat treatment temperature for a predetermined amount of time to alter the microstructure of the metallic alloy work piece with regard to at least one of grain size, phase composition and microstructural morphology.

The parameters of treatment temperature and time are tightly controlled in the treatment step 24 to provide a predetermined microstructural average grain size in the metallic alloy work piece. In one example, the microstructural average grain size after the treatment step 24 is in a range of ASTM 9-12. Furthermore, the treatment step 24 is designed to substantially avoid grain growth and recovery of the work from the first forging action 22. In the example of a nickel-based alloy, the metallic alloy work piece is held at a treatment temperature of 1650-1850° F. (898-1010° C.) for 5-60 minutes. The particular temperature and time within the given ranges depends upon the size and geometry of the metallic alloy work piece.

The metallic alloy work piece is then removed from the furnace and transferred to the second forging action 26. The parameters of the second forging action 26 with regard to temperature and percent reduction in forging height are tightly controlled. That is, the temperature and percent reduction in forging height are selected such that in one instance the second forging action 26 does not alter the microstructural average grain size achieved in treatment step 24, for example. The second forging action 26 merely provides additional work and the final shape of the metallic alloy work piece for the end use part. In another instance, the second forging action can be allowed to provide a small and predetermined amount of recrystallization for further grain size refinement and homogenization.

In one example, the second forging action 26 is conducted at a temperature of 1650-1825° F. (898-996° C.). In a further example, the temperature is approximately 1800° F. (982° C.). The temperature selected for the treatment step 24 is therefore within the temperature at which the second forging action 26 is conducted. The given temperature of the second forging action 26 in combination with a percent reduction of approximately 2-10% facilitates the avoidance of altering the microstructure in the second forging action 26.

Additionally, the percent reduction in the first forging action 22 is controlled relative to the percent reduction in the second forging action 26. In one example, the percent reductions are controlled to establish a scalable ratio such that the scalable ratio of the percent reduction in the first forging action 22 to the percent reduction in the second forging action 26 is 10:1. In a further example, the scalable ratio is about 20:1. The given scalable ratio provides that much of the work applied to the work piece is applied in the first forging action 22, to limit the influence of the second forging action 26 on the microstructure.

By controlling the temperature of the second forging action 26 and the scalable ratio between the percent reductions in area, a final component is produced with a microstructural average grain size in a range of ASTM 9-12. In comparison to a forging process that does not include the treatment step 24 in combination with the given percent reductions and forging temperatures, the microstructural average grain size of the final component that is produced according to method 20 is more homogenous with regard to grain size statistical distribution. The treatment step 24 functions as a homogenization step to control the microstructure of the metallic alloy work piece such that the average grain size has less variation. The treatment step 24 thereby allows the final component to more closely meet property requirements.

Although a combination of features is shown in the illustrated examples, not all of them need to be combined to realize the benefits of various embodiments of this disclosure. In other words, a system designed according to an embodiment of this disclosure will not necessarily include all of the features shown in any one of the Figures or all of the portions schematically shown in the Figures. Moreover, selected features of one example embodiment may be combined with selected features of other example embodiments.

The preceding description is exemplary rather than limiting in nature. Variations and modifications to the disclosed examples may become apparent to those skilled in the art that do not necessarily depart from the essence of this disclosure. The scope of legal protection given to this disclosure can only be determined by studying the following claims.

What is claimed is:

1. A method of forging comprising:

a first forging action conducted at a temperature of greater than 1800° F. (982° C.) that changes the shape of a metallic alloy work piece of a nickel-based alloy having a composition comprising 50-55 wt. % nickel, 17-21 wt. % chromium, 2.8-3.3 wt. % molybdenum, 4.75-5.5 wt. % niobium, 0.65-1.15 wt. % titanium, 0.2-0.8 wt. % aluminum and a balance of iron and trace elements, the first forging action causes 40% to 80% reduction in forging height of the metallic alloy work piece and the metallic alloy work piece has an average grain size after the first forging action in a range of ASTM 6-10 and non-uniformly distributed, and;

a second forging action conducted at a temperature of 1650-1825° F. (898-996° C.) that further changes the shape of the metallic alloy work piece after the first forging action, the second forging action causes 2-10% further reduction in the forging height of the metallic alloy work piece and the metallic alloy work piece has an average grain size after the second forging action in a range of ASTM 9-12 and homogeneous; and a heat treatment step conducted after the first forging action and prior to the second forging action, the heat treatment step including holding the metallic alloy work piece at a heat treatment temperature for a predetermined amount of time to alter the microstructure of the metallic alloy work piece without the application of a forging action that changes the shape of the metallic alloy work piece, and the heat treatment temperature is 1650-1850° F. (898-1010° C.) and the predetermined amount of time is 5-60 minutes.

* * * * *